US008942395B2

(12) United States Patent
Lissaman et al.

(10) Patent No.: US 8,942,395 B2
(45) Date of Patent: Jan. 27, 2015

(54) POINTING ELEMENT ENHANCED SPEAKER SYSTEM

(75) Inventors: Geoff Lissaman, West Jordan, UT (US); Robin M. Urry, Draper, UT (US); James D. Pennock, Salt Lake City, UT (US)

(73) Assignee: Harman International Industries, Incorporated, Northridge, CA (US)

( * ) Notice: Subject to any disclaimer, the term of this patent is extended or adjusted under 35 U.S.C. 154(b) by 1259 days.

(21) Appl. No.: 11/705,310

(22) Filed: Feb. 12, 2007

(65) Prior Publication Data

US 2008/0170729 A1 Jul. 17, 2008

Related U.S. Application Data

(60) Provisional application No. 60/881,011, filed on Jan. 17, 2007.

(51) Int. Cl.
*H04R 5/02* (2006.01)
*H04R 29/00* (2006.01)
*H04R 27/00* (2006.01)

(52) U.S. Cl.
CPC ..... *H04R 27/00* (2013.01); *H04R 29/002* (2013.01)
USPC ..... 381/303; 381/59

(58) Field of Classification Search
CPC ..... H04R 5/02; H04R 3/04; H04R 3/12; H04R 2420/07; H04R 27/00; H04S 1/002; H04B 5/00; H04B 5/0006; G01S 1/72; G01V 1/00; G01V 1/001
USPC ..... 381/300, 303–307, 311, 58–59, 82, 381/87–89, 332–336; 181/30; 33/286; 367/95, 99
See application file for complete search history.

(56) References Cited

U.S. PATENT DOCUMENTS

| | | | | |
|---|---|---|---|---|
| 5,430,802 | A * | 7/1995 | Page | 381/96 |
| 6,859,417 | B1 * | 2/2005 | Houg | 367/96 |
| 7,367,423 | B2 * | 5/2008 | Ferrell et al. | 181/187 |
| 7,372,771 | B2 * | 5/2008 | Park | 367/99 |
| 7,706,558 | B2 * | 4/2010 | Sack et al. | 381/335 |
| 2001/0029675 | A1 * | 10/2001 | Webb | 33/286 |
| 2002/0025053 | A1 * | 2/2002 | Lydecker et al. | 381/305 |
| 2002/0136414 | A1 * | 9/2002 | Jordan et al. | 381/58 |
| 2005/0008165 | A1 * | 1/2005 | Sack et al. | 381/59 |
| 2005/0035246 | A1 * | 2/2005 | Coleman | 248/131 |
| 2008/0137893 | A1 * | 6/2008 | Ross et al. | 381/332 |

* cited by examiner

*Primary Examiner* — Xu Mei
(74) *Attorney, Agent, or Firm* — Brooks Kushman P.C.

(57) ABSTRACT

A pointing element enhanced speaker system addresses the need for consistent sound. Despite wide variations in the design and architecture of different venues, the system helps performers ensure that they deliver the desired sound for their audiences. Performers and their technicians, though faced with grueling schedules that impose severe time constraints on equipment setup and tuning as the performers move between venues, may turn to the system to provide the sound desired at each new venue.

26 Claims, 13 Drawing Sheets

POINTING ELEMENT ENHANCED SPEAKER SYSTEM

PRIORITY CLAIM

This application claims the benefit of priority from U.S. Provisional Patent Application No. 60/881,011, filed 17 Jan. 2007.

BACKGROUND OF THE INVENTION

1. Technical Field

This disclosure relates to speaker systems. In particular, this disclosure relates to a pointing element enhanced speaker system for providing consistent sound at any given venue.

2. Related Art

Performers expect consistently excellent and repeatable sound from their speaker systems. However, in the past, significant variations between venues often led to inconsistent sound, despite the best efforts of sound technicians who setup the speaker system. Additional complications arise due to the wide range of parameters that influence the sound output. As examples, tuning the sound quality at a new venue may include ensuring consistent volume levels, optimizing the dispersion pattern, detecting and eliminating any phasing inconsistencies, or configuring other sound signal characteristics throughout the venue. As one venue may differ significantly from the next, the system configuration that provided maximum dispersion at the previous venue, for example, may not be well-suited for the next venue.

An additional practical consideration is that sound technicians are under severe time constraints to set up and configure the speaker system at the new venue. In the case of a touring music group, for example, the group's speaker system often arrives at the venue just hours before the first performance. Thus, in addition to basic system setup tasks, the sound technicians must also manually adapt the speaker system as best they can in a very short time to the specific nuances of the new venue so that the speaker system produces the consistent sound that the group desires.

The modern speaker arrays that are part of some speaker systems complicate the already difficult configuration task. Speaker arrays provide multiple aligned speakers that the speaker system drives in an interrelated manner in an attempt to achieve specific audio reproduction characteristics, such as dispersion. However, the interrelation between speakers can increase the difficulty of adapting the speaker system to produce the desired sound output.

In the past, sound technicians followed an imprecise routine when attempting to tune a speaker system for each venue. The sound technicians typically visited a small number of locations in the venue and at their own discretion for monitoring sound quality. Even experienced sound technicians cannot always determine the best and consistent locations at which to listen. The sound technicians therefore could not always be efficient or sufficiently precise in determining or resolving sound output issues.

Alternatively, sound technicians employed a simplified procedure in which the sound technician would monitor and collect data at a single sound control station typically located near the center or rear portion of the venue. The sound technicians then optimized the sound output at that location. While optimizing sound output at a central location may be fast, the sound output at potentially many other locations throughout the venue was often poor.

Therefore, a need exists for an improved system for more effectively, consistently, and flexibly tuning a speaker system to deliver a desired sound.

SUMMARY

A pointing element enhanced speaker system addresses the need for consistent sound regardless of venue. Despite wide variations in the design and architecture of different venues, the pointing element enhanced speaker system ensures that performers are able to deliver the sound that they desire for their audiences as they move from one venue to the next. The pointing element enhanced speaker system directs a sound technician precisely to the locations where sound output tuning measurements are desired.

The pointing element enhanced speaker system identifies a measurement location in a venue using a pointing element associated with a speaker. The pointing element enhanced speaker system receives location characteristic information about the measurement location and determines an adjustment parameter from the location characteristic information. The pointing element enhanced speaker system may also adjust the speaker according to the adjustment parameter. The pointing element may be a mechanical pointer, an electronically controlled pointer such as a laser, or may be implemented with other pointing technologies or combinations of technologies. The pointing element enhanced speaker system may exercise automated control over electronic pointers to direct measurement technicians to the appropriate measurement locations.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The pointing element enhanced speaker system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
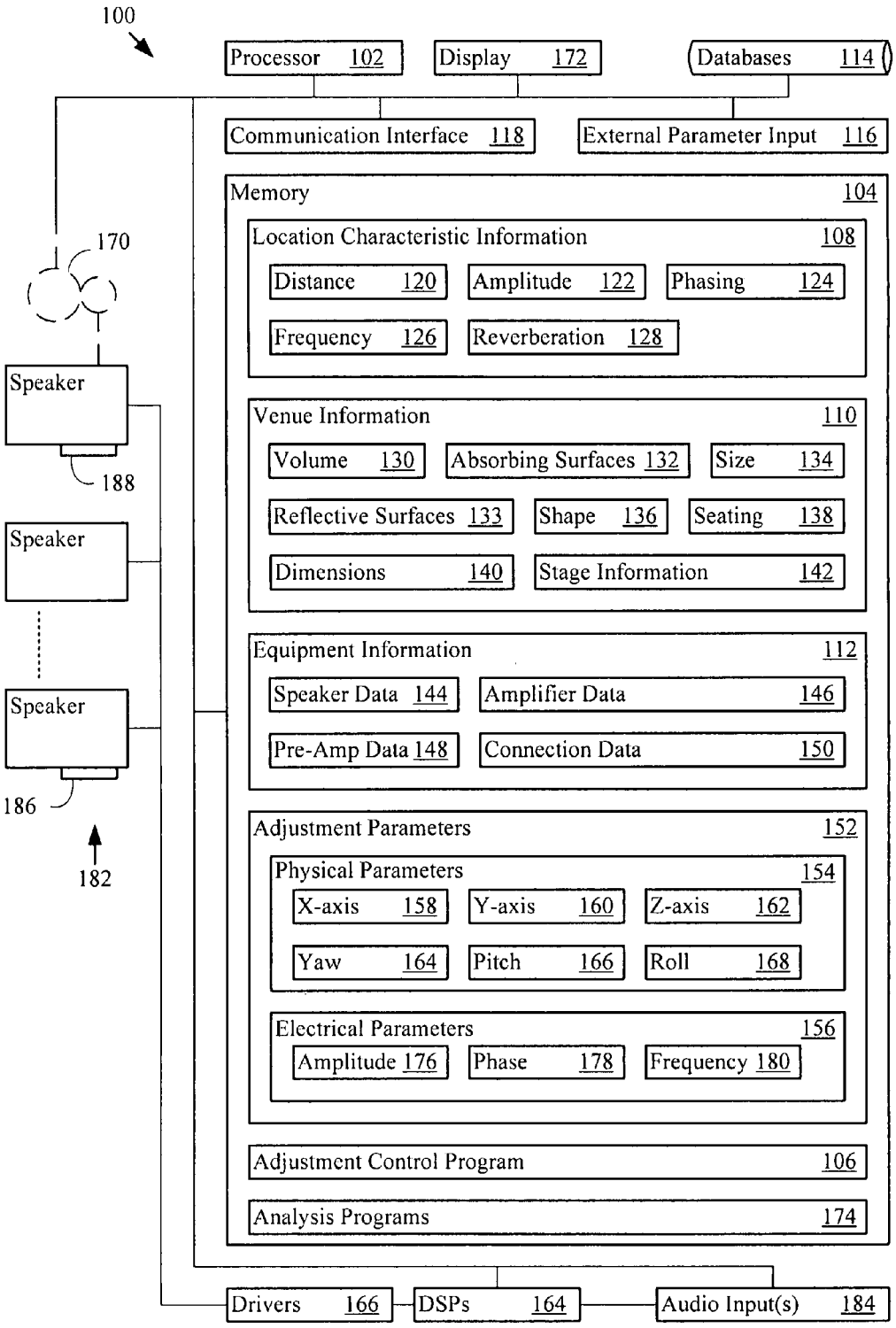
FIG. 1 shows a pointing element enhanced speaker system.

FIG. 1 shows a pointing element enhanced speaker system 100 ("system 100"). The system 100 uses pointing elements associated with one or more speakers or speaker arrays located in a venue to help provide a desired sound output from a speaker system. FIG. 1 shows two pointing elements 186 and 188 associated with two of the speakers 182. The desired sound output may be one that has a particular dispersion pattern, particular loudness, frequency content, or directionality at one or more selected venue locations, or that has any other sonic attributes that the speaker system should produce. The system 100 includes a system processor 102 and a system memory 104. As will be discussed in more detail below, the system processor 102 may execute an adjustment control program 106 to identify a measurement location in the venue from which to obtain location characteristic information 108, for example. The system 100 may determine adjustment parameters for speaker system components that take into consideration the location characteristic information 108 as well as venue information 110, equipment information 112, and other information in order to adapt a speaker system for delivering the desired sound output.

The location characteristic information 108, venue information 110, and equipment information 112 may additionally or alternatively be obtained from databases 114, through operator input at an external input 116 (e.g., a keyboard, a speech recognition interface, or a mouse), through a communication interface 118 (e.g., through a network connection to a data warehouse, to equipment in the speaker system, such as an amplifier or mixer, or to other logic) or from other sources. As examples, the databases 114 may be local or remote databases that store venue information, equipment information, or location characteristic information or that store the results of previous venue, equipment, and location characteristic information gathering, analysis, or determinations.

The location characteristic information 108 may include distance information 120, such as the distance between the measurement location and a speaker, group of speakers, or other reference point. The location characteristic information 108 may also include acoustic signal information such as amplitude 122, phasing 124, frequency 126, reverberation 128, or other information characteristic of an acoustic signal. Thus, the location characteristic information 108 may capture the signal characteristics that exist at any given measurement location (e.g., the amplitude or reverberation decay time of the audio signal at the measurement location) as well as the physical characteristics of the measurement location (e.g., the distance to the speaker).

The venue information 110 may include a full or partial layout of the venue or other architectural parameters (e.g., dimensions, materials, or construction information), or other physical data about the venue. One example of the venue information 110 is the physical volume of the venue 130. Other examples of venue information 110 include the number and/or location of audio absorbing surfaces 132 and the number and/or location of audio reflective surfaces 133. Additional examples of venue information 110 include the venue size 134, venue shape 136, venue seating capacity or arrangement 138, the venue dimensions 140, and stage information 142. The stage information 142 may include the locations, sizes, orientations, or arrangements of one or more stages in the venue. The venue information may be expressed in objective or subjective terms. For example, the venue size 134 may be expressed in terms of measured dimensions, or expressed as 'large', 'medium', or 'small'. The system 100 may also obtain setup information as part of the venue information 110. The setup information may specify the position and/or orientation of the speakers after initial setup. The setup information may be manually input by a technician, automatically sensed by the speaker (e.g., using GPS sensors, roll, pitch, or yaw sensors, or other sensors) and transmitted to the system 100, or may be obtained in other ways.

The equipment information 112 may specify equipment characteristics for equipment in the speaker system. As examples, the equipment information 112 may include speaker data 144, amplifier data 146, pre-amp data 148, connection data 150, or other equipment information. The speaker data 144, amplifier data 146, and pre-amp data 148 may specify the number of speakers, amplifiers, and pre-amplifiers, their connection topology, the speaker models, physical or electrical characteristics, including efficiency, power capability, frequency response, and dispersion pattern. The connection data 150 may specify the type, length, and electrical characteristics of system interconnections, such as speaker cables and amplifier/pre-amplifier audio cables. Other equipment information may be provided.

As noted above, the location characteristic information 108, venue information 110, and equipment information 112 may be obtained from the databases 114, through an external input 116, through a communication interface 118 or from other sources. In addition, the system 100 may implement data entry user interfaces that facilitate obtaining the information 108, 110, and 112. For example, the data entry user interface may be a graphical or text input user interface provided on the display 172. The display 172 may be one or more displays local to the system 100, or may be displays integrated into or associated with any of the speaker system equipment (e.g., an LCD display on an amplifier). The external input 116 may be a system keyboard, mouse, or other input device, or additionally or alternatively may be keys, buttons, thumb wheels, or other interface devices provided by a component interface in the speaker system (e.g., an amplifier control interface). In one implementation, the system implements a "wizard" interface. The wizard interface may include one or more display prompts and input selectors that progressively lead the operator through each step of the information gathering process. The wizard interface may provide convenient drop down menu selections, radio button selections, text input interfaces, interactive graphical elements (e.g., manipulable lines, charts, widgets, or graphical elements) and other interface elements through which the operator provides the information 108, 110, and/or 112.

The adjustment parameters 152 may include physical adjustment parameters 154 and electrical parameters 156. Any of the adjustment parameters 152 may be provided on a per-component basis, such as for each speaker or amplifier, or may be provided on a group basis, such as for two or more speakers in a speaker array. In other words, the granularity of the adjustment parameters 152 may be as coarse or as fine as desired. The physical adjustment parameters 154 may include x, y, and/or z-axis adjustment information 158, 160, and/or 162 for one of more speakers. The x, y, and z-axis adjustment information 158, 160, and 162 represents a location adjustment for the speaker in an x, y, and/or z direction relative to the speaker or other adjustment reference point. The physical adjustment parameters 154 may also include a yaw adjustment 164, pitch adjustment 166, roll adjustment 168 and/or other information related to adjusting physical speaker alignment. The adjustment parameters 152 may be given in other coordinate systems, however, such as a spherical or cylindrical coordinate system.

The electrical parameters 156 may specify amplitude, time alignment, phase, and frequency adjustment information 176, 178, and 180, or other adjustment information. The electrical parameters 156 may be expressed relative to other system components (e.g., a phase difference for speaker 1 relative to speaker 2), or relative to a fixed metric (e.g., a phase of 35 degrees behind a fixed reference signal). The electrical parameters 156 may account for interactions between system components, such as the interactions of multiple speakers in a speaker array.

The processor 102 executes the adjustment control program 106 ("program 106"). The program 106 may coordinate the processing performed by the pointing element enhanced speaker system 100. For example, the program 106 may activate and/or position the pointing elements, gather the location characteristic information 108 and store it in the memory 104, initiate execution of, or pass the information to, an analysis program, receive adjustment parameter results from the analysis program and store them in the memory 104, and suggest, initiate, or carry out physical, electrical, or other speaker adjustments based on the adjustment parameters.

The system 100 may also include special purpose processors. For example, one or more Digital Signal Processors (DSPs) 164 may be provided. The DSPs 164 may digitally manipulate signal samples that determine the sound output from one or more speaker system speakers 182, including applying signal processing algorithms, applying the electrical adjustment parameters 156, or taking other processing steps. The DSPs 164 may interface with driver logic 166, such as pre-amplifiers, amplifiers, signal conditioners, or any other logic that influences an audio signal delivered to the speakers 182.

In addition, the system 100 may include physical positioning adjustment mechanisms 170 coupled to one or more of the speakers 182. The physical positioning adjustment mechanisms 170 facilitate physical speaker adjustment using motors, gears, gimbals, or other positioning elements. While FIG. 1 shows the processor 102 connected to the mechanisms 170, the system 100 may provide additional or different control logic to drive the mechanisms 170, such as special purpose motor controllers, amplifiers, and feedback mechanisms.

The system 100 may receive audio information on one or more audio inputs 184 or other sources (e.g., from music files stored in the database 114). The audio inputs 184 may be analog inputs, digital inputs, optical inputs, or other types of signal inputs. As examples, the audio inputs 184 may include an analog microphone, pre-amp, or CD player input, a Musical Instrument Digital Interface input, an optical Sony/Philips Digital Interface input, or other type of audio input. The system 100 may process the audio information for delivery to the speakers 182.

Figure 2:
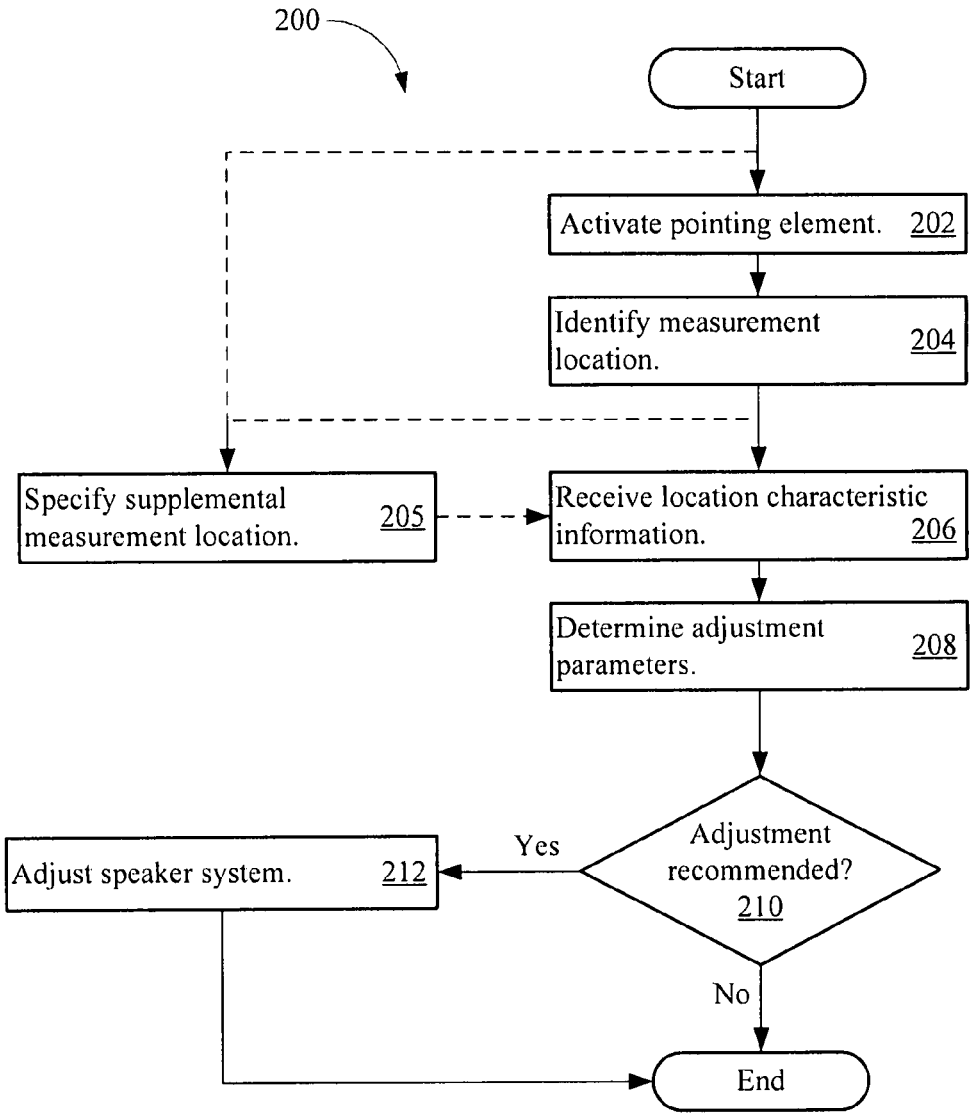
FIG. 2 shows acts the pointing element enhanced speaker system may take to adjust a speaker system located in a venue to provide the sound desired for the venue.

FIG. 2 shows acts 200 that the system 100 and program 106 may take to adjust a speaker system in a venue to provide a desired sound output from the speaker system. The system 100 may activate an electrically controlled pointing element associated with the speaker (Act 202). The pointing element may be an integral part of the speaker, secured to the speaker, arranged relative to the speaker, or otherwise associated with the speaker, such that the pointing element identifies a measurement location in the venue for the speaker. In other words, rather than have a technician wander ad hoc through the venue taking measurements, each pointing element guides the technician to the measurement location by using the pointing device associated with that speaker. The pointing device may, as examples, point in a line of sight along an axis through the bass, treble, tweeter, or other speaker cone, or along a line of sight along a side of the speaker enclosure.

The pointing device indicates (e.g., by illuminating in the visible or non-visible wavelengths) a measurement location in the venue at which the speaker contributes to the desired sound. A speaker may include multiple pointing elements associated with multiple speaker characteristics. For example, the speaker may include a pointing element for each speaker cone. Alternatively or additionally, the speaker may include a pointing element for one or more surfaces, edges, or corners of the speaker. In implementations in which each speaker cone (or other element or characteristic) is physically or electrically adjustable in addition to or as an alternative to the speaker as a whole, the system 100 may then adjust each element or characteristic based on the location characteristic information returned from each corresponding measurement location. As examples, the system 100 may activate adjustment mechanisms such as gears, motors, gimbals, tracks, carriages, or other physical positioning devices to adjust the x, y, and z location of the speaker or component of the speaker, or the roll, pitch, and yaw of the speak or a component of the speaker. The system 100 may also adjust the electrical characteristics of the speaker using amplifiers, phase delays, filters, or other circuitry that influences the phase, frequency, or amplitude of the audio signal fed to the speaker. For speaker arrays, the system 100 may provide individual adjustments to each speaker or to groups of speakers in the speaker array by adjusting the speaker signals fed to individual speakers or groups of speakers.

Using the pointing element, the system 100 identifies the measurement location for the speaker (Act 204). The pointing element may vary widely in implementation. For example, the pointing element may be a laser secured to the speaker that identifies the measurement location by pointing to a spot in the venue. As another example, the pointing element may alternatively comprise a lamp indicator pointing system. The lamp indicator pointing system may include a bulb, incandescent lamp, LED, or other light emitting device. As one example, the pointing device may be located at the back of the speaker, with an opening defined at the front of the speaker. By looking for the light, a technician may move through the venue and identify the measurement location as the location where the light emitting device is visible through the opening defined at the front of the speaker. As another example, the light emitting device may include a colored LED and a colored lens located at the front of the speaker such that the alignment of the LED and colored lens produces a specific color. For example, alignment of a red LED and blue lens may result in seeing a purple light. The location at which a technician sees a purple light may be indicated as the measurement location for the speaker.

More generally, the pointing element may transmit electromagnetic energy to the measurement location. The electromagnetic energy need not be in the visible wavelengths, but may instead be detectible by a receiver that the technician carries. The electromagnetic energy may embed, encode, or otherwise carry information. The information may be defined using modulation techniques and may be organized into communication frames or data packets, as examples. The information may include speaker, pointing element, or measurement location identification information, technician instructions, or any other information.

The pointing element may also be a mechanical device. For example, the pointing element may be a first shape (e.g., a circle) located at the back of the speaker and a second shape (e.g., a circle with a different diameter) located at the front of the speaker. The location within the venue where the shape at the front and back of the speaker are lined-up may be identified as the measurement location for that speaker.

The system 100 may receive location characteristic information 108 obtained from or based on the measurement location (Act 206). The location characteristic information 108 may be the distance 120 between the speaker and the measurement location. The location characteristic information 108 may also include information such as amplitude 122, phasing 124, frequency 126, reverberation 128, or other sound information measured at the measurement location. In that regard, the system 100 may instruct one or more speakers located in the venue to emit a test signal for measurement. After the measurements are taken, the system 100 receives the location characteristic information 108 related to the test signal as detected at the measurement location. Alternatively or additionally, the technician may activate one or more speakers or pointing elements manually or electronically, such as through a remote control.

The system 100 may receive the location characteristic information 106 wirelessly, through a direct connection, through manual input, or through other communication methods. For example, the system 100 may receive location characteristic information 108 collected at the measurement location on a laptop, PDA, or other device that supports a wireless communication. The location characteristic information 108 may alternatively be stored on a portable electronic device and then connected to the system 100, or a computer or other computing device in communication with or included within the system 100.

The system 100 may also receive location characteristic information 106 reflected from the measurement location. For example, where the pointing element is optical in nature, such as a laser, a mirror or other reflecting device may reflect the optical signal to a sensor (e.g., attached to the speaker) to determine the distance 120 between the speaker and the measurement location.

Based on the received location characteristic information 108, the system 100 determines adjustment parameters 152 (Act 208). The adjustment parameters 152 may include amounts by which the speaker or signal sent to the speaker may be adjusted to improve the sound quality produced by the speaker. For example, the adjustment parameters 152 may include yaw 164, pitch 166, and/or roll 168 adjustments (e.g., angular displacements) of the speaker. The adjustment parameters 152 may also include recommended adjustments (e.g., displacement distances) of the speaker in an x, y, and/or z directions. Furthermore, as noted above, the system 100 may adjust electrical characteristics of any of the system components by determining and applying the electrical adjustment parameters 156. Any of the adjustments may apply to an individual speaker, whether or not part of a speaker array, or to groups or subsets of speakers, including multiple speakers in a speaker array.

Other implementations of the system 100 may include specifying any point in the venue as a supplemental measurement location (Act 205). The technician may obtain location characteristic information from the supplemental measurement locations in addition to or as an alternative to the pointing element identified measurement locations. As an example, the system 100 may communicate supplemental measurement locations to a communication device carried by the technician. The supplemental measurement locations may be identified using coordinates (e.g., CPS coordinates), using descriptive information (e.g., the first row—center seat; last row—center seat; each corner of the venue, the far left and far right isles on the floor, first row and last row; or in the balcony), or in other manners. As another example, the supplemental measurement location may be part of a pre-established set of known measurement locations from which to obtain location characteristic information for a venue. The system 100 may determine the adjustment parameters 152 from the pointing element identified measurement locations alone, the supplemental locations alone, or from both types of locations.

In determining the adjustment parameters 152, the program 106 may initiate execution of one or more characteristic analysis program 174. The analysis programs 174 may evaluate the location characteristic information 108 and determine or establish the adjustment parameters 152. The analysis program may vary between implementations depending on the desired analysis. Alternatively, the system 100 may include multiple analysis programs, analysis programs specific to a particular venue, analysis programs specific to a particular adjustment parameter, or other analysis program configurations.

The system 100 may determine whether speaker system adjustments are recommended (Act 210). For example, the system 100 may determine whether the analysis program has returned non-zero linear or angular adjustment parameters or electrical adjustment parameters. The system 100 may alternatively compare the adjustment parameters 152 to one or more thresholds. The system 100 may include a threshold for each adjustment parameter, such as an x-axis threshold or yaw threshold. When at least one of the adjustment parameters 152 exceeds the corresponding threshold, the system 100 may determine that speaker system adjustment is recommended.

The system 100 may also compare an aggregate threshold to an aggregate adjustment value. The aggregate adjustment value may take into account an aggregate (e.g., a weighted sum) of the adjustment parameters 152 that is analyzed to determine whether adjustment is recommended. For example, the system 100 may consider the recommended adjustment for each individual adjustment parameter 152 as influenced by a weight (e.g., x, y, and z displacement parameters may be given more or less weight than roll, pitch, and yaw displacement parameters). When the aggregate adjustment value does not exceed the aggregate threshold, the system 100 may determine that no adjustment is recommended.

When the system 100 determines that speaker system adjustment is recommended, the system 100 may adjust the speaker system according to the adjustment parameters 152 (Act 212). To that end, the system 100 may control motors, gimbals, gears, translational slides, rotational couplings, or other physical positioning adjustment mechanisms 170 coupled to one or more speakers 182 to facilitate physical speaker adjustment for any of the speakers connected to the speaker system, including speakers in speaker arrays as well as stand alone speakers. For example, the system 100 may issue motor control commands or assert motor control signals that cause a motor to adjust the speaker 144 in the x, y, or z direction, or rotate the speakers along a roll, pitch, or yaw axis. As another example, the system 100 may adjust phase delay, amplitude adjustment, or filtering logic to adjust the electrical characteristics of the audio signals delivered to any speaker or multiple speakers, including speakers in a speaker array or stand alone speakers. Additionally or alternatively, the system 100 may display the adjustment parameters 152 on the display 172. A technician may then adjust the speaker system according to the displayed adjustment parameters 152.

Figure 3:
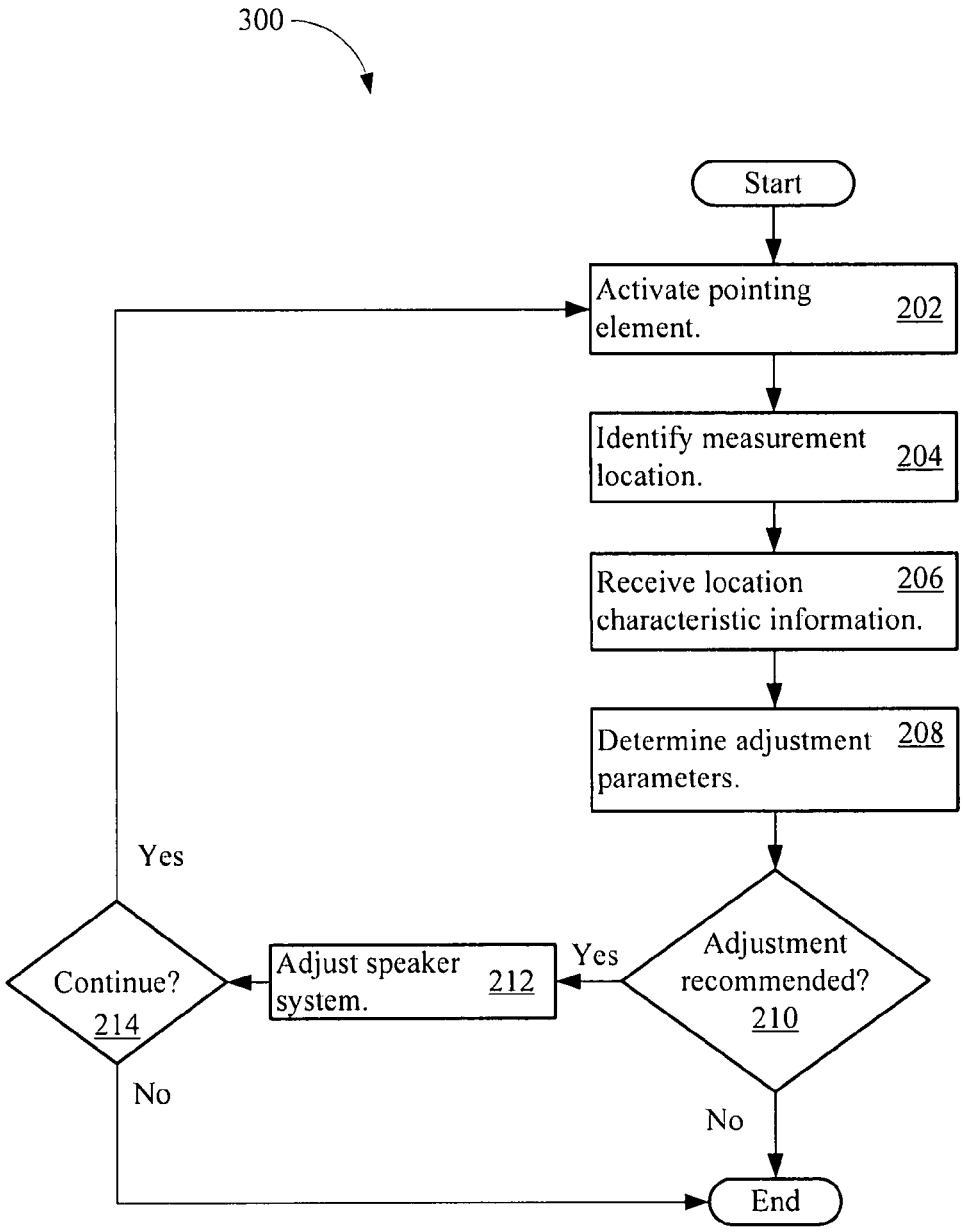
FIG. 3 shows acts the pointing element enhanced speaker system may take to iteratively adjust a speaker system located in a venue.

FIG. 3 shows an extension of FIG. 2. In particular, FIG. 3 illustrates acts 300 the system 100 may take to iteratively adjust a speaker system located in a venue. The system 100 obtains location characteristic information and adjusts the speaker as noted above with regard to FIG. 2. After the speaker system is adjusted, the system 100 may determine whether to obtain additional location characteristic information (Act 214). The system 100 may continue receiving location characteristic information and making speaker system adjustments as long as desired. For example, the system 100 may repeat the adjustment process until the system 100 no longer recommends speaker system adjustments. As another example, the system 100 may repeat the measurement and adjustment steps for a pre-determined number of iterations.

Figure 4:
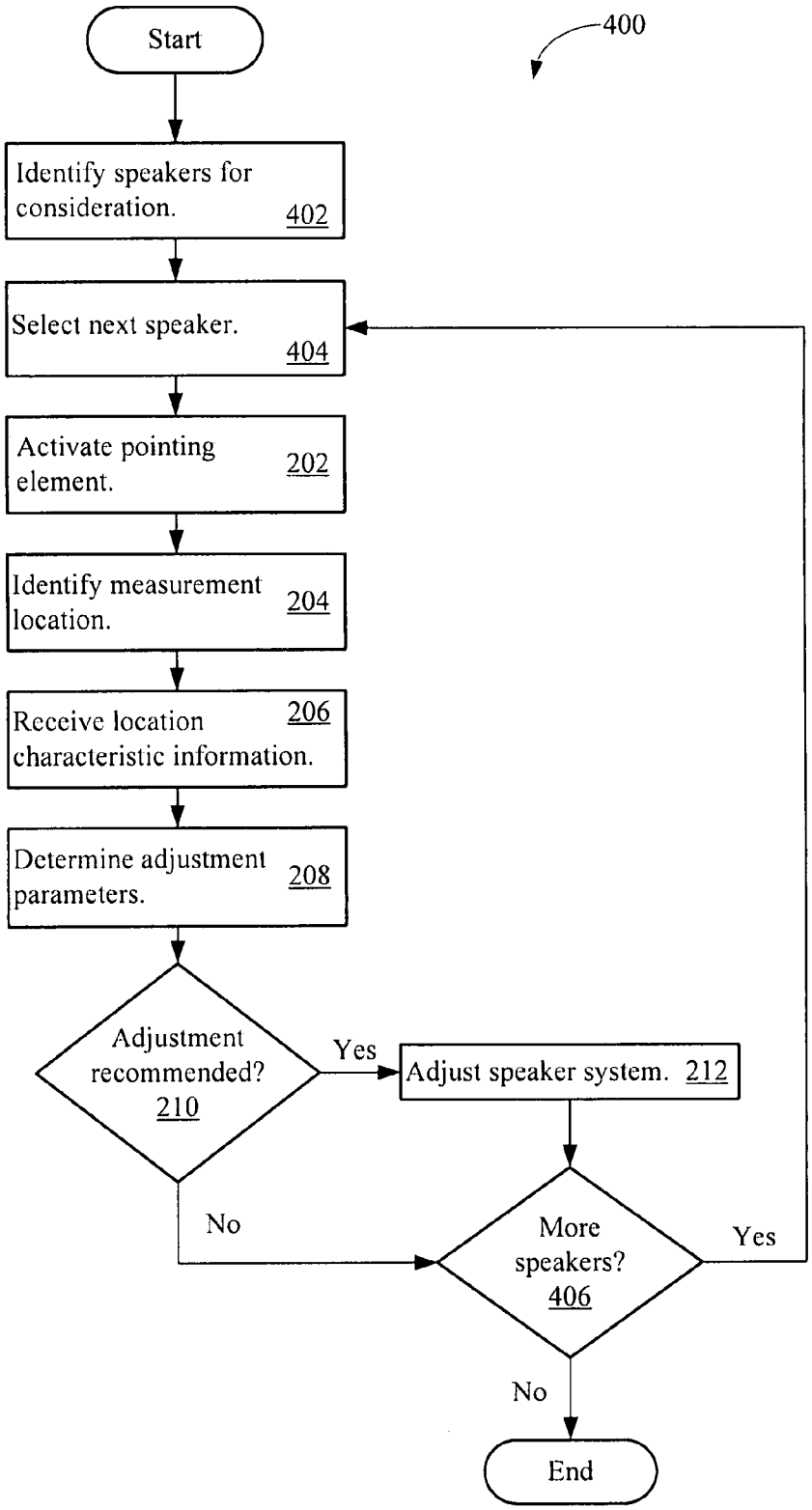
FIG. 4 shows acts the pointing element enhanced speaker system may take to a speaker system in a venue.

FIG. 4 shows acts 400 the adjustment control program 106 may take to adjust the speaker system in response to location characteristic information obtained from locations specified by pointing elements associated with multiple speakers in a venue. The system 100 identifies the speakers located in the venue for which associated pointing elements will specify measurement locations (Act 402). The system 100 may consider all of the speakers in the venue or a subset of the speakers in the venue, such as the speakers directed to a specific section of the venue. As one example, a technician may manually identify the speakers that the system 100 should adjust. However, the system 100 may also automatically determine the speakers to adjust, based on, for example, speaker specification data or other equipment information 112 in the memory 104.

From among the identified speakers, the system 100 selects the next speaker (Act 404). With respect to the selected speaker, the system 100 activates the pointing element associated with that speaker to identify the measurement location, activates one or more speakers (e.g., to generate sound, such as emitting a test signal), and receives location characteristic information (Acts 202-206). The system 100 also determines speaker system adjustment parameters (e.g., by initiating execution of an analysis program and receiving the speaker adjustment parameters), determines whether adjustment is recommended, and if so adjusts the speaker system (Acts 208-212). The system 100 continues by determining whether additional speakers in the venue should be considered (Act 406). If so, the system 100 selects the next speaker and proceeds as noted above.

Figure 5:
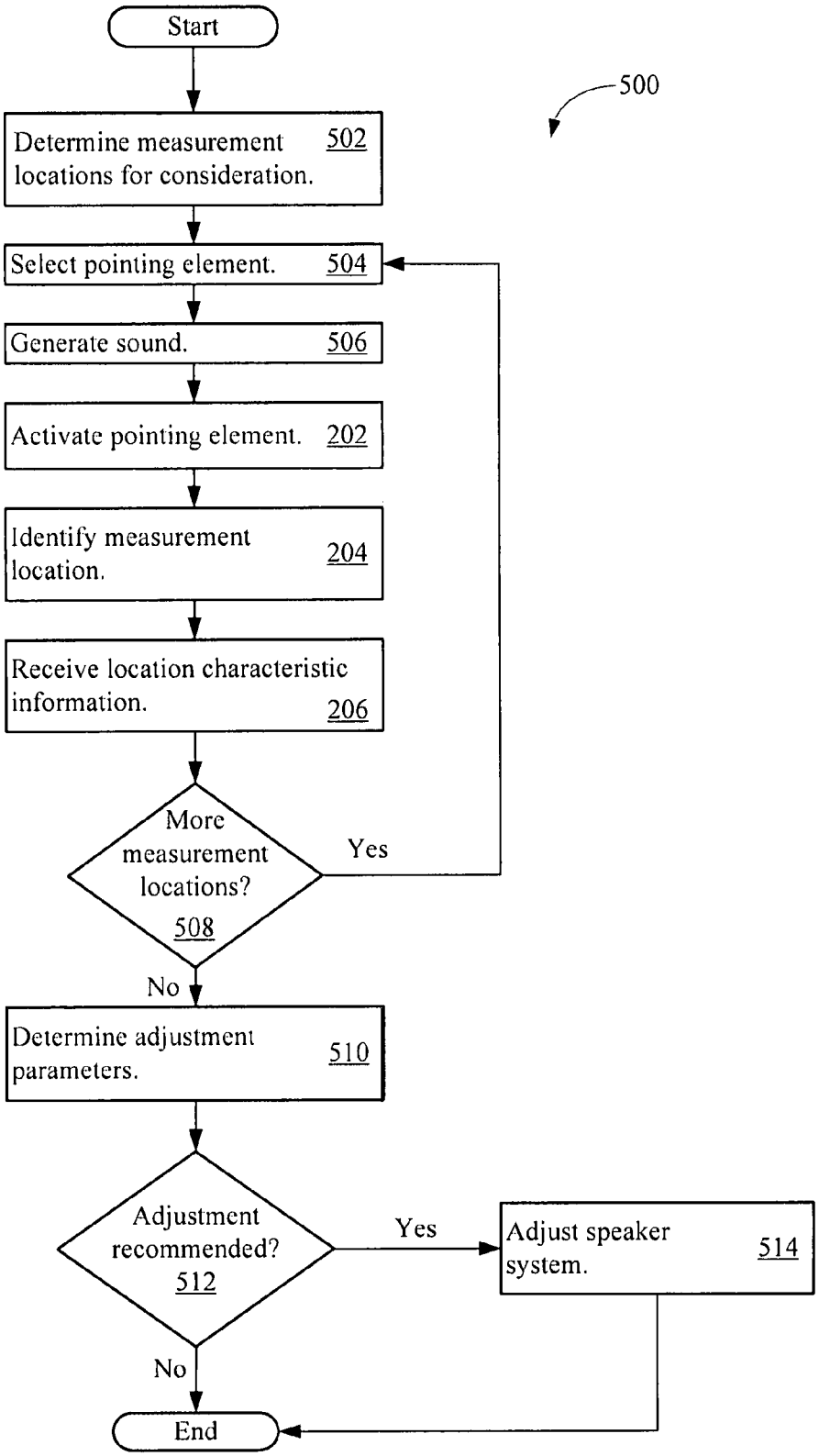
FIG. 5 shows acts the pointing element enhanced speaker system may take to adjust a speaker system in a venue.

FIG. 5 shows an example in which the system 100 obtains location characteristic information from multiple measurement locations for determining adjustment parameters. The system 100 determines measurement locations for consideration (Act 502). A pointing element associated with one or more speakers may be used to identify the measurement location from which to obtain location characteristic information. The system 100 selects the pointing element (Act 504). In addition, the system 100 activates one or more speakers to generate sound, such as a test signal (Act 506). The sound may change or may stay the same between measurement locations.

The system 100 activates the pointing element (Act 202) that identifies a desired measurement location in the venue (Act 204). The system 100 receives location characteristic information 108 from the measurement location (Act 206), including, as examples, audio characteristics of the sound generated by the speakers at the measurement location, physical information (e.g., distance), and other location characteristic information. The system 100 determines whether there are more measurement locations to be considered (Act 508). Where there are more measurement locations to be considered, the system 100 selects the next pointing element that will identify the next measurement location and continues to obtain additional location characteristic information. Accordingly, for example, when the speaker is part of a speaker array, the system 100 may consider the location characteristic information 108 obtained from multiple measurement locations identified by pointing elements associated with speakers in the speaker array to determine the adjustment parameters 152 for a speaker or for multiple speakers in the array.

Once the system 100 has obtained location characteristic information from each of the measurement locations, the system 100 determines adjustment parameters 152 for the speaker system (Act 510), such as physical or electrical adjustment parameters for one or more speakers. The system 100 determines whether adjustment is recommended (Act 512). If so, the system 100 adjusts the speaker system according to the adjustment parameters 152 (Act 514). To that end, the system 100 may make or initiate physical adjustments to one or more speakers, make or initiate electrical adjustments to one or more speaker signals that feed a speaker or speaker array, or take other actions.

Figure 6:
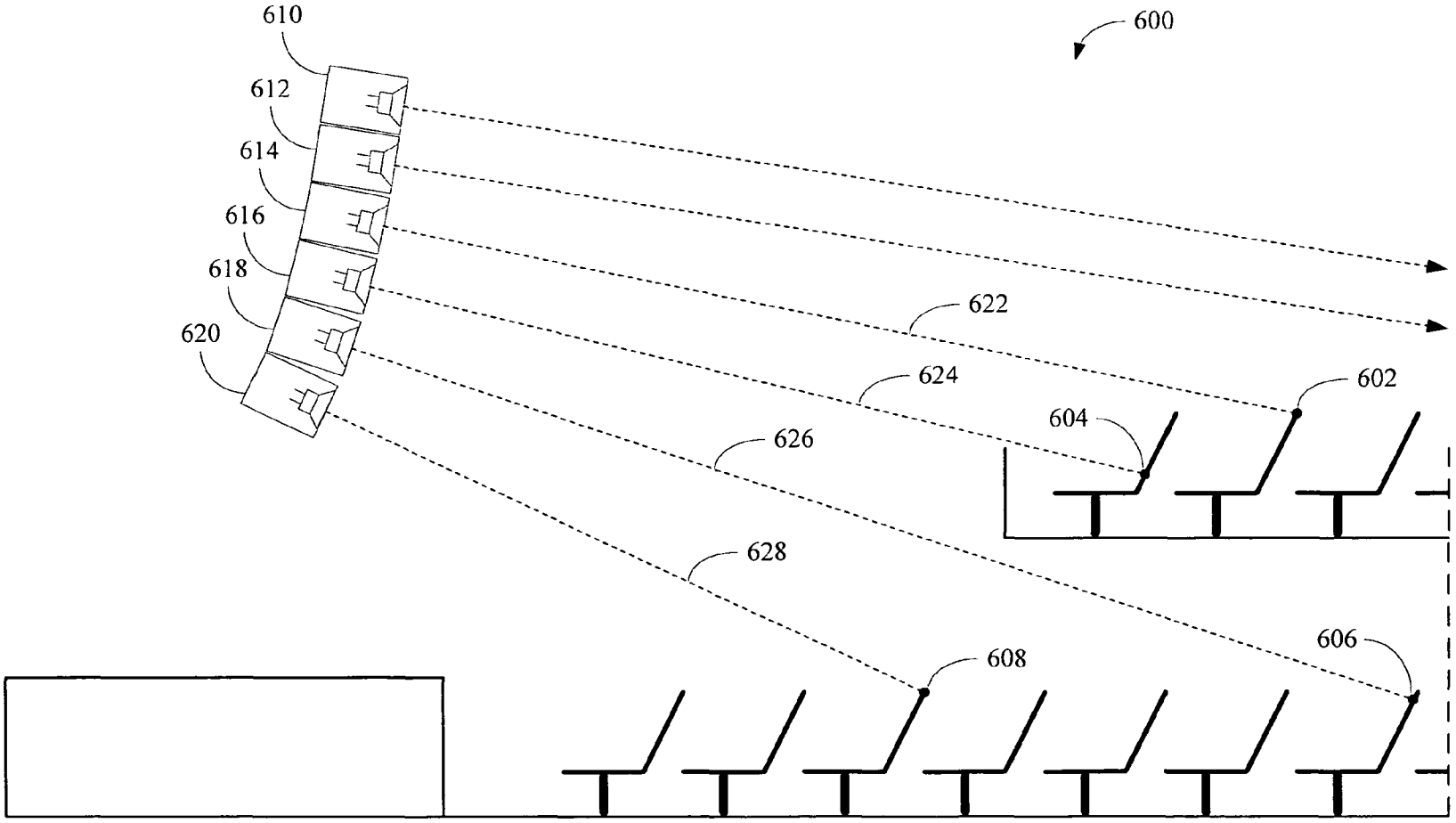
FIG. 6 shows a venue including identified measurement locations corresponding to multiple speakers.

FIG. 6 shows a venue 600. Several measurement locations 602-608 are identified in the venue and correspond to pointing elements associated with the individual speakers 614-620, respectively. The measurement locations 602-608 may be identified, for example, by illuminating rays 622, 624, 626, and 628 generated by a lamp, LED, laser, or other illumination source attached to the speakers 614-620. A technician may visit each measurement location 602-608 and measure location characteristic information. The location characteristic information is returned to the system 100 for consideration and potential speaker adjustments.

Figure 7:
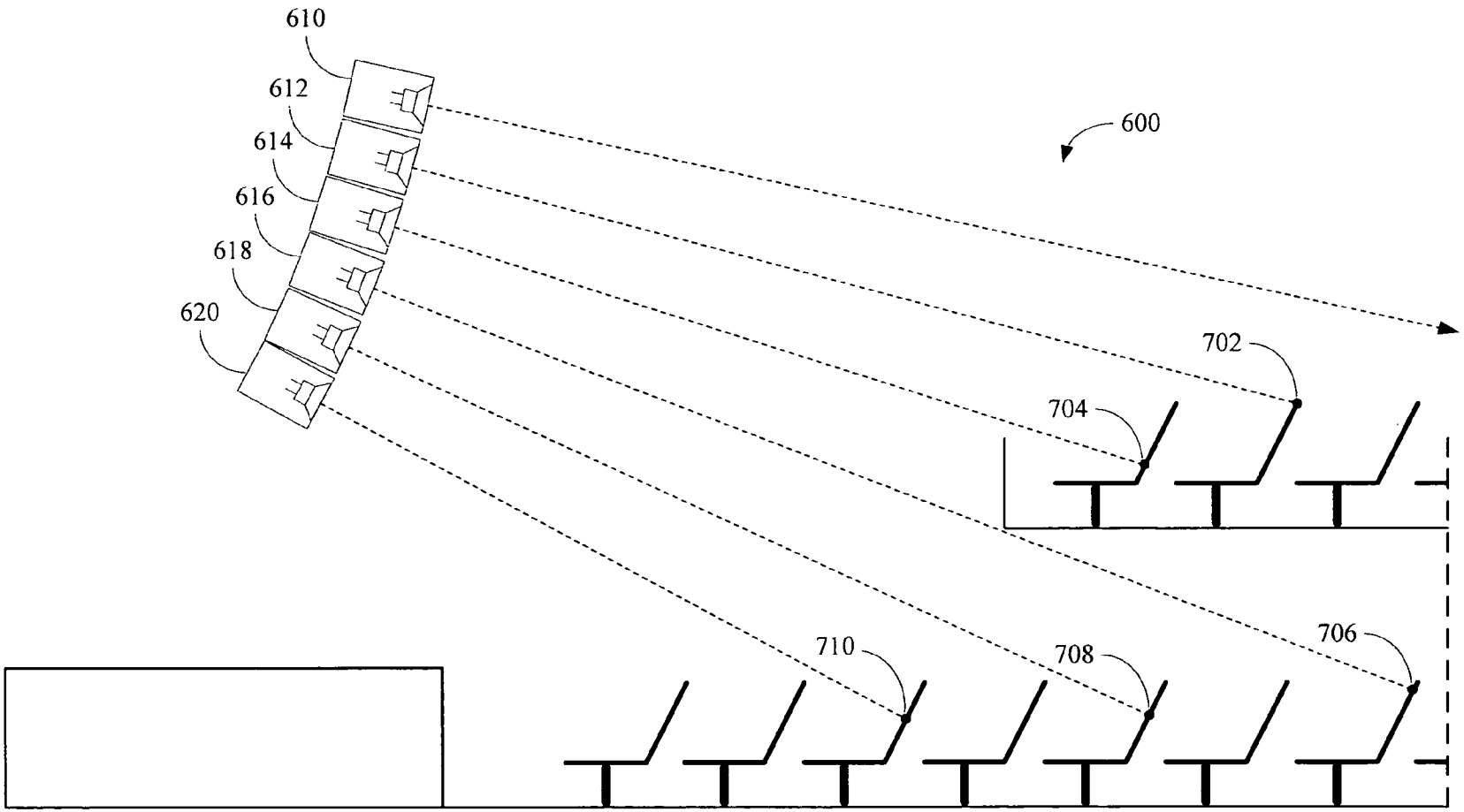
FIG. 7 shows the venue shown in FIG. 6 including speakers adjusted to improve sound quality within the venue.

FIG. 7 shows the venue 600 with the speakers 610-620 adjusted to improve the sound. In other words, based on the location characteristic information obtained form the measurement locations 602-608, the system 100 obtained adjustment parameters and adjusted the speakers 610-620 physically or electrically. As noted above, the system 100 may iteratively adjust the speakers using location characteristic information obtained from the new measurement locations 702-710.

Figure 8:
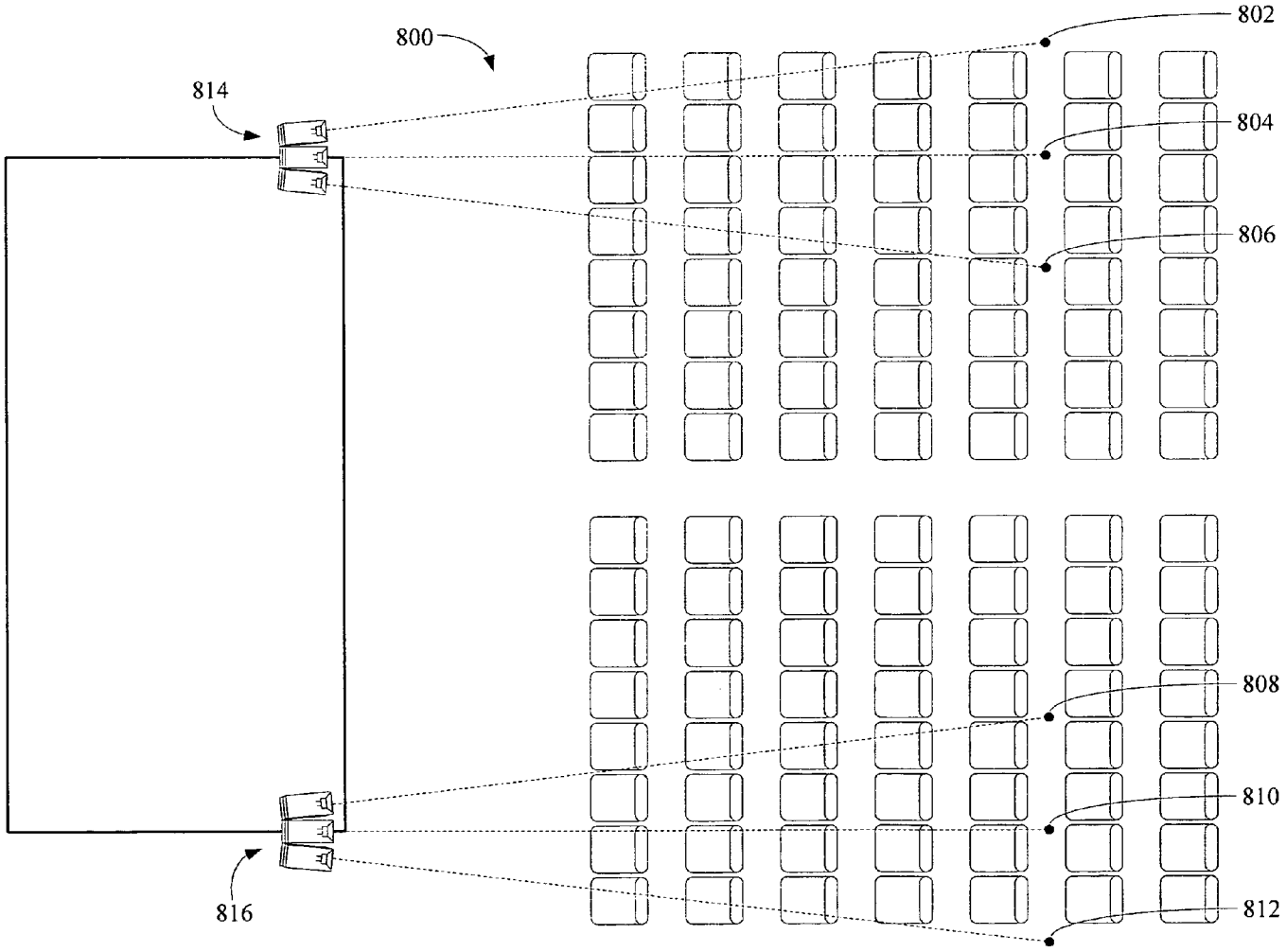
FIG. 8 shows a venue including identified measurement locations relative to multiple speaker groups.

FIG. 8 shows an example of a venue 800 including identified measurement locations 802-812 relative to two speaker arrays 814 and 816. A pointing element associated with each speaker in each speaker array 814 and 816 mechanically or electronically illuminates a particular measurement location 802-812 associated with a particular speaker. The system 100 receives location characteristic information 106 obtained at the measurement locations 802-812 and obtains the adjustment parameters 110. When adjustment is recommended, the system 100 responsively recommends adjustment or performs adjustment of the speaker system, which may include adjustment of the arrays 814 and 816 according to the adjustment parameters 152.

Figure 9:
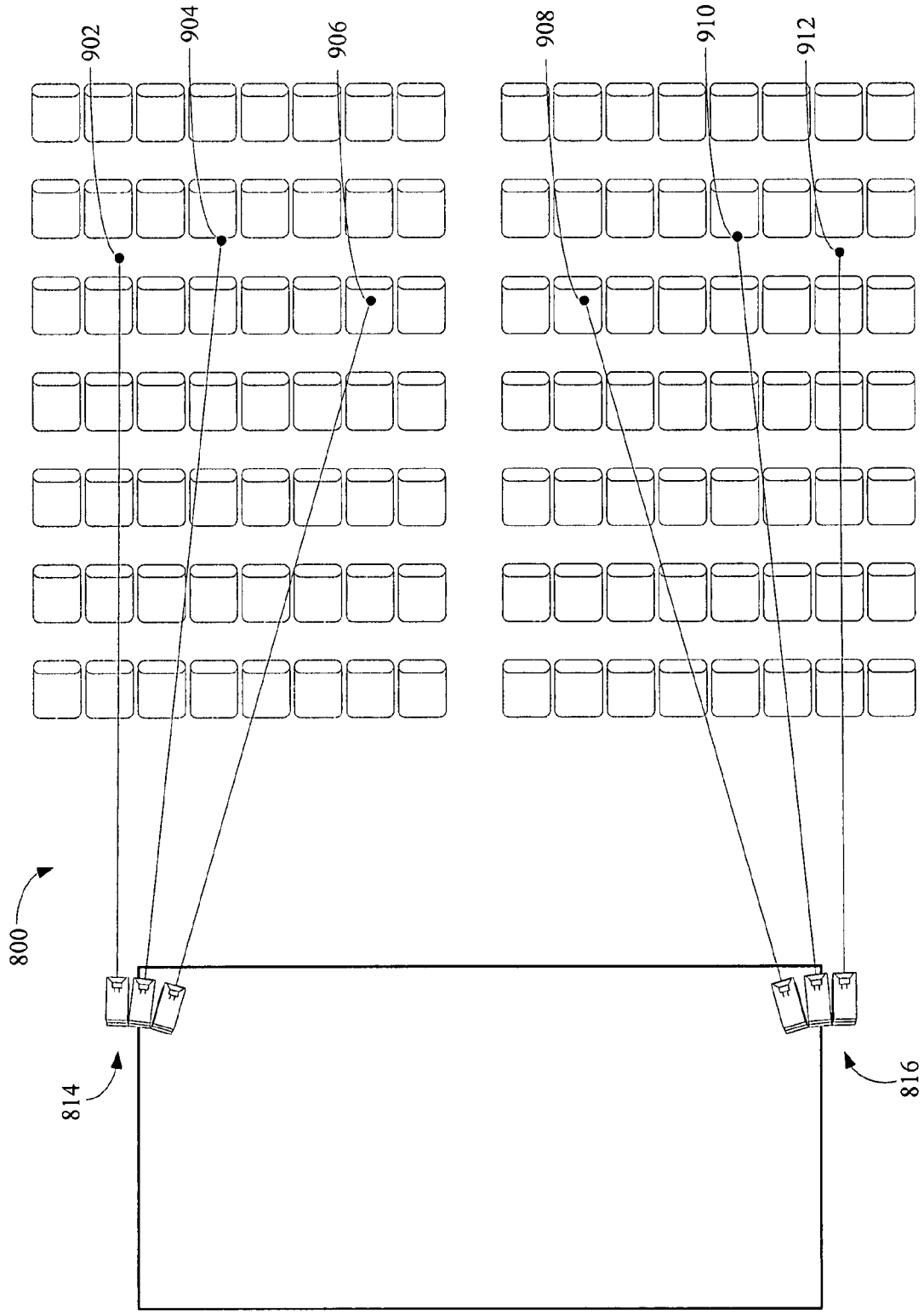
FIG. 9 shows the venue shown in FIG. 8 including speaker groups adjusted to improve sound quality within the venue.

FIG. 9 shows the venue 800 shown in FIG. 8 including speaker arrays 814 and 816 adjusted to improve the sound. The system 100 received the location characteristic information measured at the measurement locations 602-608, obtained adjustment parameters, and electrically or physically adjusted the speakers in the speaker arrays 814 and 816. The system 100 may iteratively adjust the speakers in the speaker arrays 814 and 816, or make other speaker system adjustments, using location characteristic information obtained from the new measurement locations 902-912.

Figure 10:
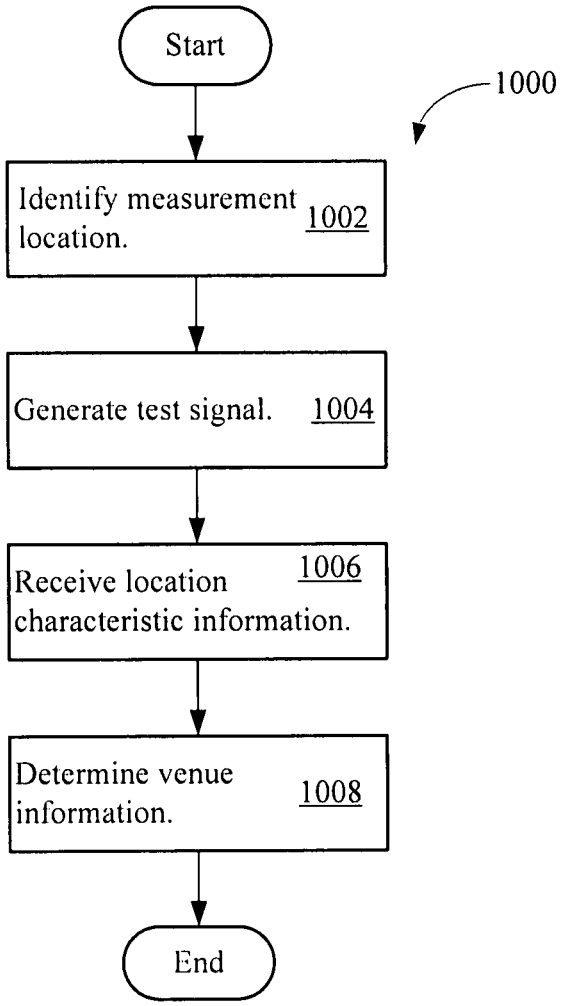
FIG. 10 shows the acts the pointing element enhanced speaker system may take to determine venue information.

FIG. 10 shows the acts 1000 the system 100 may take to determine venue information 108. The system 100 identifies a measurement location using a pointing element (Act 1002) and may instruct one or more speakers to emit a test signal (Act 1004). The system 100 receives location characteristic information 106 measured at the measurement location (Act 1006). The location characteristic information may provide the amplitude 122, phasing 124, frequency 126, reverberation 128 or any other acoustic signal features of the test signal. The system 100 may analyze the location characteristic information 108 to determine the venue information 110 (Act 1008). For example, the system 100 may initiate execution of a venue analysis program that determines the venue information 110 from the location characteristic information. Alternatively or additionally, the system 100 may accept operator input that specifies the venue information 110 or request venue information 110 from local or remote databases 114.

Figure 11:
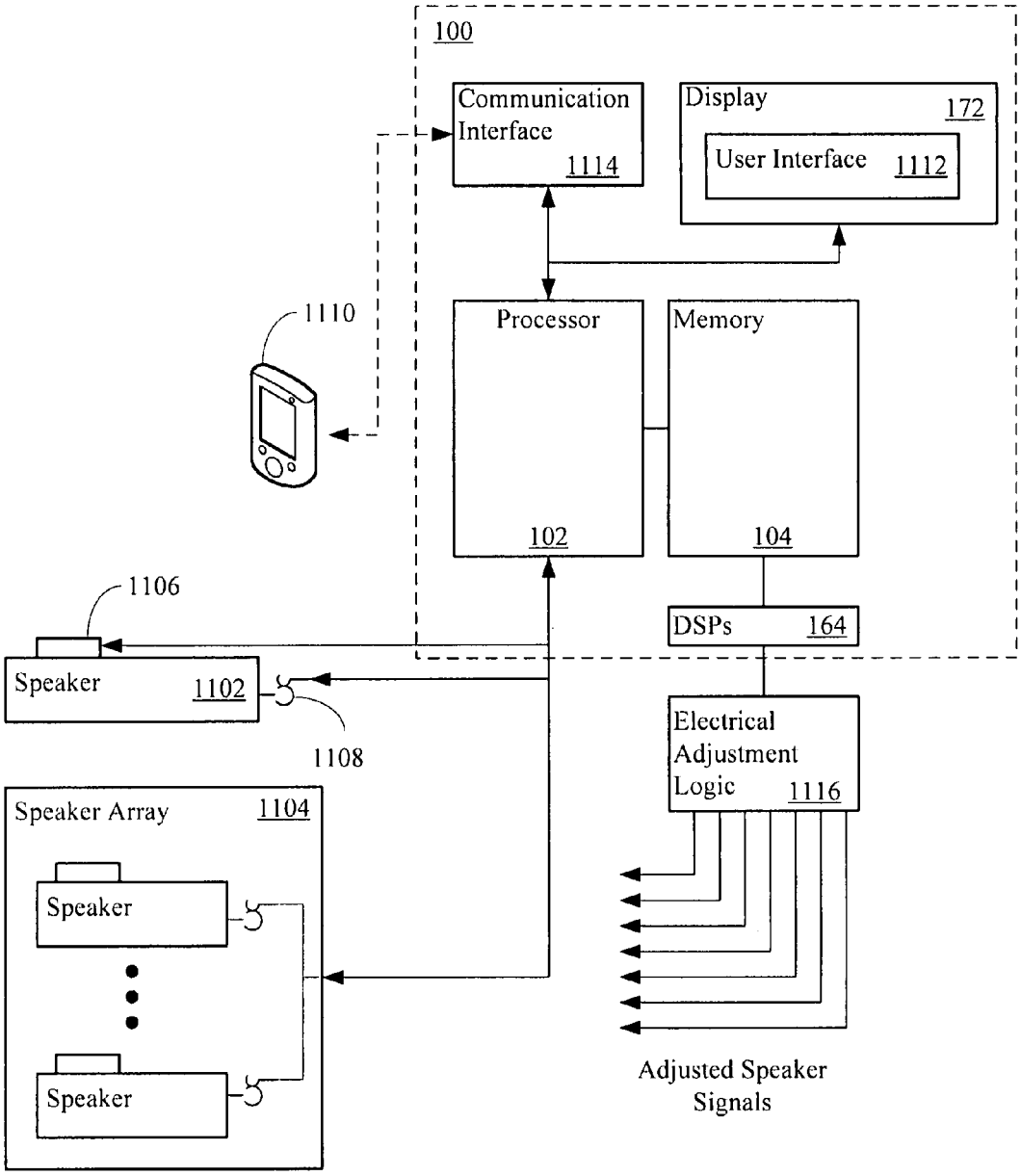
FIG. 11 shows a pointing element enhanced speaker system.

FIG. 11 shows the system 100 coupled to a stand alone speaker 1102 and a speaker array 1104. One or more of the speakers includes a pointing element (e.g., the pointing element 1106) that indicates a measurement location to a technician. One or more of the speakers may also be coupled to a physical adjustment mechanism (e.g., the physical adjustment mechanism 1108). The adjustment mechanisms may be controlled by the system 100 or, additionally or alternatively, manually adjusted by a technician. In addition, the system 100 is connected to electrical adjustment logic 1116, such as filters, amplifiers, phase delays, time delays, or other electrical parameter adjustment logic configured to provide electrically adjusted speaker signals. The electrical adjustment logic 1116 may be provided for any one or more stand alone speakers, or any one or more speakers alone or grouped together in one or more speaker arrays.

A measurement device 1110 communicates location characteristic information obtained from the measurement locations to the system 100. The measurement device 1110 may interface with the communication interface 1114. The communication interface 1114 may be a wireless interface (e.g., a WiFi, ZigBee, or WiMax interface), a wired network interface (e.g., an Ethernet network interface), a serial, parallel, USB, or firewire port, or other communication interface.

The adjustment control program 106 may also include instructions for displaying the adjustment parameters 152 on a user interface 1112. A technician may use the displayed adjustment parameters 152 to manually adjust the speaker 1102 or speaker array 1104. In implementations in which the system 100 includes automatic adjustment logic, the user interface 1112 may accept input from the technician to validate, accept, reject, or modify the recommended adjustments before the system 100 performs the adjustments. The user interface 1112 may be displayed on the display 172 (e.g., local to the system 100), on the measurement device 1110, or may be communicated through the communication interface 1114 to any of the speaker system equipment for local display, thereby allowing the technician to make adjustments while moving in the venue, gathering additional location characteristic information or performing other tasks.

Figure 12:
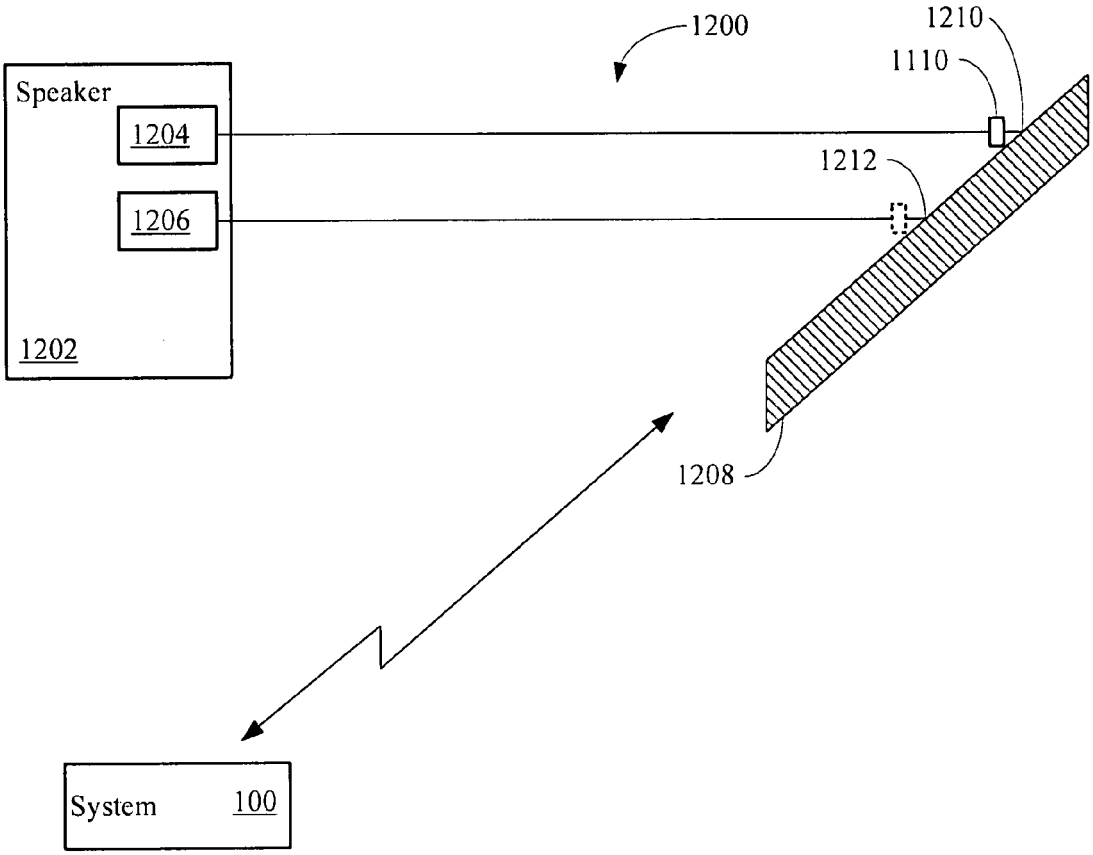
FIG. 12 shows a speaker using multiple pointing elements to illuminate a surface.

FIG. 12 shows a portion of a venue 1200 in which the system 100 uses the speaker 1202 to determine characteristics of the venue 1200. The speaker 1202 includes a first pointing element 1204 and a second pointing element 1206. Additional or fewer pointing elements may be used. The system 100 activates the pointing elements 1204 and 1206 in any order or combination to illuminate measurement locations 1210 and 1212 on the physical venue feature 1208. In FIG. 12, the physical venue feature 1208 is an angled wall, however any other venue feature may be illuminated with one or more pointing elements.

The measurement device 1110 collects location characteristic information at each of the measurement locations 1210 and 1212. For example, the measurement device 1110 may collect distance information from each measurement location 1210 and 1212 to the pointing element that illuminates the respective measurement location 1210 and 1212. As a result, the technician, measurement device 1110, system 100, or other entity may analyze the location characteristic information to determine venue information. In the example shown in FIG. 12, the different distances to the different pointing elements may be analyzed to determine the angle of the wall at which the speaker 1202 points. The system 100 may take any such venue information into consideration in determining the adjustment parameters 152. Thus, the arrangement shown in FIG. 12 provides a two dimensional analysis of the feature 1208.

Figure 13:
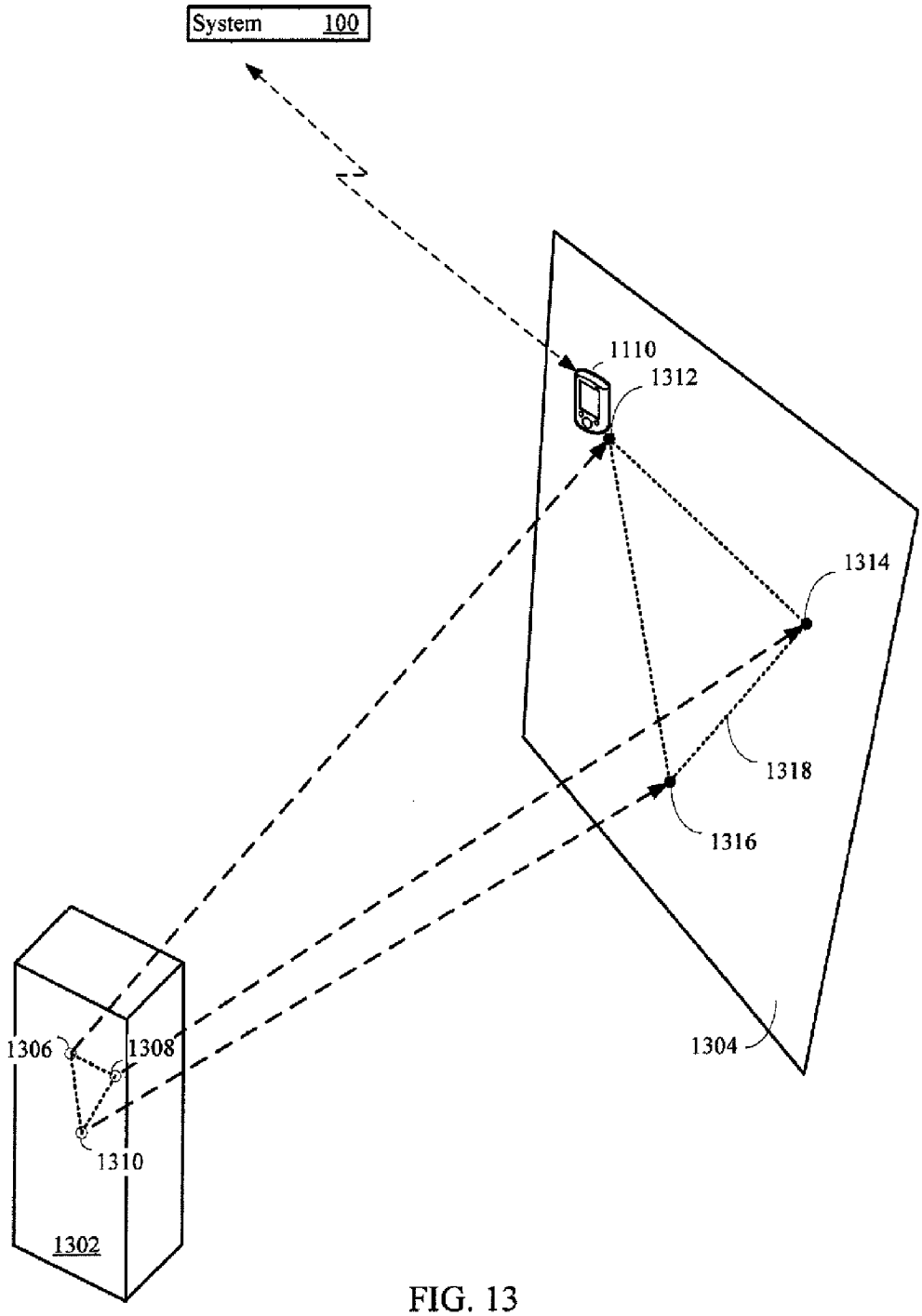
FIG. 13 shows a speaker using multiple pointing elements to illuminate a surface.

FIG. 13 shows a second example of determining characteristics of a venue. In FIG. 13, the system 100 uses the speaker 1302 to determine characteristics of the venue wall 1304. The speaker 1302 includes three pointing elements: a first pointing element 1306, a second pointing element 1308, and a third pointing element 1310. Additional or fewer pointing elements may be used. In the example shown in FIG. 13, the pointing elements 1306, 1308, and 1310 are located on the front planar surface of the speaker 1302 and provide illumination normal to the surface, but may instead be located or associated with the speaker 1302 in other locations, arrangements, or angles.

The system 100 activates the pointing elements 1306, 1308, and 1310 in any order or combination to illuminate the measurement locations 1312, 1314, and 1316 on the venue wall 1304. In FIG. 13, the venue wall 1304 forms a plane that is not parallel with the front surface of the speaker. As a result, the measurement locations 1312, 1314, and 1316 identify vertices of a triangle 1318 that differ in distance from their respective pointing elements 1306, 1308, and 1310. The measurement device 1110 may determine such location characteristic information and communicate the location characteristic information back to the system 100. The system 100 may then determine that the venue wall 1034 forms a plane that is not parallel to the front surface of the speaker 1302 by analyzing the distance measurements. The system 100 may derive a wide variety of venue information for consideration in making speaker adjustments from the location characteristic information, such as location of the venue wall 1304, the relative angles formed by the venue wall 1304 with respect to a basis measurement, such as the front of the speaker, or any other venue information.

The pointing elements may fill other roles in the system 100. For example, the system 100 may activate the pointing elements to provide a light show, as error, warning, or status indicators, or to communicate other information. In one implementation, the system 100 activates and deactivates the pointing elements (e.g., during a performance) in synchronism with audio signals, according to a pre-programmed pattern and timing sequence stored in the memory 104, in response to manual input through the user interface 1112, in response to input received at the communication interface 1114, randomly, or in other manners.

Although selected aspects, features, or components of the implementations are depicted as being stored in memories, all or part of the systems, including methods and/or instructions for performing methods, consistent with the pointing element enhanced speaker system may be stored on, distributed across, or read from other machine-readable media. The machine-readable media may include, for example, secondary storage devices such as hard disks, floppy disks, and CD-ROMs; a signal received from a network; or other forms of ROM or RAM either currently known or later developed.

Specific components of a pointing element enhanced speaker system may include additional or different components. A processor may be implemented as a microprocessor, a microcontroller, a DSP, an application specific integrated circuit (ASIC), discrete logic, or a combination of other types of circuits or logic. Similarly, memories may be DRAM, SRAM, Flash or any other type of memory. The processing capability of the system 100 may be distributed among multiple system components, such as among processors embedded in amplifiers, mixers, or speakers. The system components may be networked together to exchange venue, equipment, and location characteristic information 108, 110, and 112, or to exchange adjustment parameters 152. Parameters, databases, and other data structures may be separately stored and managed, may be incorporated into a single memory or database, or may be logically and physically organized in many different ways. Programs and instruction sets may be parts of a single program, separate programs, or distributed across several memories and processors.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for adjusting a speaker system within a venue comprising:

providing a pointing element associated with a speaker, the pointing element includes an illumination source for being positioned at the speaker such that the illumination source transmits light to a location within the venue to identify the location within the venue at which the speaker directs sound, the pointing element with the illumination source provides an indication that a measurement device is positioned at the location when the measurement device is placed at the location;

identifying the location as a measurement location within the venue at which to obtain location characteristic information;

receiving location characteristic information for the measurement location, the location characteristic information including distance information indicative of a distance between the speaker and the measurement location;

determining an at least one adjustment parameter based on the distance information of the location characteristic information; and executing a speaker system adjustment to angularly displace the speaker based on the at least one adjustment parameter.

2. The method of claim 1, further comprising activating the pointing element.

3. The method of claim 1, further comprising initiating generation of a test signal through the speaker.

4. The method of claim 1, where executing the speaker system adjustment comprises:

activating a physical adjustment mechanism coupled to the speaker to angularly displace the speaker.

5. The method of claim 1, further comprising:

initiating execution of an electrical adjustment parameter analysis program.

6. The method of claim 1, where determining the adjustment parameter comprises:

determining the at least one adjustment parameter in response to location characteristic information obtained from multiple measurement locations.

7. The method of claim 6, further determining whether to initiate the speaker system adjustment by:

comparing the at least one adjustment parameter to an adjustment threshold; and executing the speaker system adjustment when the at least one adjustment parameter, exceeds the adjustment threshold.

8. The method of claim 1, further comprising:

obtaining additional location characteristic information from a supplemental measurement location.

9. The method of claim 1, wherein the location characteristic information further includes amplitude, phasing, frequency, and a reverberation decay time of the sound directed from the speaker at the measurement location.

10. The method of claim 1 further comprising:

receiving venue information indicative of one of a full layout and partial layout of the venue;

receiving equipment information indicative of at least one of speaker data, amplifier data, and pre-amp data such that the at least one adjustment parameter is determined based on the location characteristic information, the venue information, and the equipment information.

11. The method of claim 1 wherein the at least one adjustment parameter includes one of a yaw adjustment, a pitch adjustment, and a roll adjustment relating to the speaker.

12. A speaker system comprising:

a pointing element for being positioned with a speaker, the pointing element includes an illumination source positioned at the speaker such that the illumination source transmits light to a location within a venue to identify the location within the venue at which the speaker directs sound, and the pointing element with the illumination source provides an indication that a measurement device is positioned at the location when the measurement device is placed at the location;

a processor;

a memory coupled to the processor and storing an adjustment control program operable to cause the processor to:

activate the pointing element to identify the location as a measurement location at which to obtain location characteristic information;

receive location characteristic information for the measurement location indicated by the pointing element, the location characteristic information including distance information indicative of a distance between the speaker and the measurement location;

determine at least one adjustment parameter based on the distance information of the location characteristic information; and cause the processor to execute a speaker system adjustment to angularly displace the speaker based on the at least one adjustment parameter.

13. The system of claim 12, further comprising an adjustment mechanism coupled to the speaker, and where the adjustment control program is operable to activate the adjustment mechanism to angularly displace the speaker.

14. The system of claim 12, wherein the location characteristic information further includes amplitude, phasing, frequency, and a reverberation decay time of the sound directed from the speaker at the measurement location.

15. The system of claim 12, where the speaker comprises a line array speaker.

16. The system of claim 12, further comprising:

a communication interface;

a measurement device operable to store the location characteristic information; and where the communication interface is operable to communicate with the measurement device to obtain the location characteristic information from the measurement device.

17. The system of claim 12, where the processor is further operable to:

obtain additional location characteristic information from a supplemental measurement location; and determine the at least one adjustment parameter using the location characteristic information for the measurement location and the additional location characteristic information for the supplemental measurement location.

18. The system of claim 12, where the processor is further operable to:

additionally control the pointing element to fill an additional role different than identifying the measurement location.

19. The system of claim 12 wherein the memory includes venue information indicative of one of a full layout and partial layout of the venue and equipment information indicative of at least one of speaker data, amplifier data, and pre-amp data such that the at least one adjustment parameter is determined based on the location characteristic information, the venue information, and the equipment information.

20. The system of claim 12 wherein the at least one adjustment parameter includes one of a yaw adjustment, a pitch adjustment, and a roll adjustment relating to the speaker.

21. A product comprising:

a machine readable medium; and instructions stored on the machine readable medium for execution by a processor and that cause the processor to:

receive location characteristic information for a location at which a speaker directs sound in response to an illumination source of a pointing element positioned with the speaker transmitting light to the location to identify the location as a measurement location, and the pointing element with the illumination source provides an indication that a measurement device is positioned at the location when the measurement device is placed at the location;

determine at least one adjustment parameter based on distance information of the location characteristic information, the distance information being indicative of a distance between the speaker and the location; and execute a speaker system adjustment to angularly displace the speaker based on the at least one adjustment parameter.

22. The product of claim 21 wherein the location characteristic information further includes amplitude, phasing, frequency, and a reverberation decay time of the sound directed from the speaker at the measurement location.

23. The product of claim 21, where the instructions are further operable to cause the processor to:

obtain additional location characteristic information from a supplemental measurement location; and determine the at least one adjustment parameter using the location characteristic information for the measurement location and the additional location characteristic information for the supplemental measurement location.

24. The product of claim 21, where the instructions are further operable to cause the processor to:

control the pointing element to fill an additional role different than pointing to the measurement location.

25. The product of claim 21 where the instructions are further operable to cause the processor to receive venue information indicative of one of a full layout and partial layout of the venue and equipment information indicative of at least one of speaker data, amplifier data, and pre-amp data such that the at least one adjustment parameter is determined based on the location characteristic information, the venue information, and the equipment information.

26. The product of claim 21 wherein the at least one adjustment parameter includes one of a yaw adjustment, a pitch adjustment, and a roll adjustment relating to the speaker.

* * * * *